United States Patent [19]

Arisato et al.

[11] 4,138,267

[45] Feb. 6, 1979

[54] COMPOSITIONS FOR CHEMICAL COPPER PLATING

[75] Inventors: Yasunori Arisato, Daito; Hideaki Koriyama, Nara, both of Japan

[73] Assignee: Okuno Chemical Industry Company, Limited, Osaka, Japan

[21] Appl. No.: 755,030

[22] Filed: Dec. 28, 1976

[51] Int. Cl.[2] ..... C23C 3/02

[52] U.S. Cl. ..... 106/1.23; 427/305; 427/437; 106/1.26

[58] Field of Search ..... 106/1, 1.23, 1.26; 427/437, 305

[56] References Cited

U.S. PATENT DOCUMENTS

| | | | |
|---|---|---|---|
| 2,938,805 | 5/1960 | Agens | 106/1 |
| 3,347,724 | 10/1967 | Schneble et al. | 106/1 X |
| 3,615,733 | 10/1971 | Shipley et al. | 106/1 |
| 3,635,758 | 1/1972 | Schneble et al. | 106/1 X |
| 3,650,777 | 3/1972 | Schneble et al. | 106/1 X |
| 3,770,464 | 11/1973 | Dutkewych et al. | 106/1 |
| 3,959,531 | 5/1976 | Schneble et al. | 106/1 X |

FOREIGN PATENT DOCUMENTS

| | | | |
|---|---|---|---|
| 674883 | 11/1963 | Canada | 106/1 |

*Primary Examiner*—Herbert B. Guynn
*Attorney, Agent, or Firm*—Larson, Taylor and Hinds

[57] ABSTRACT

A composition for chemical copper plating having a pH of 12 to 14 and containing a boron hydride compound serving as a reducing agent, a water-soluble copper compound and a copper complexing agent, the composition being characterized in that the copper complexing agent is at least one of hydroxyalkyl-substituted ethylenediamines represented by the formula

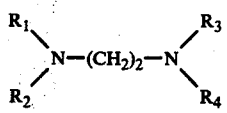

(I)

wherein $R_1$, $R_2$, $R_3$ and $R_4$ are the same or different and are each unsubstituted lower alkyl or hydroxyl- and/or carboxyl-substituted lower alkyl, and at least one of $R_1$, $R_2$, $R_3$ and $R_4$ is hydroxyl-substituted lower alkyl, and hydroxyalkyl-substituted diethylenetriamines represented by the formula

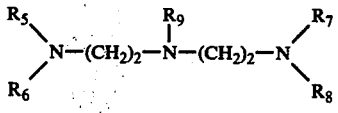

(II)

wherein $R_5$, $R_6$, $R_7$ and $R_8$ are the same or different and are each unsubstituted lower alkyl or hydroxyl-and/or carboxyl substituted lower alkyl, $R_9$ is hydrogen or unsubstituted lower alkyl or hydroxyl-and/or carboxyl-substituted lower alkyl, and at least one of $R_5$, $R_6$, $R_7$, $R_8$ and $R_9$ is hydroxyl-substituted lower alkyl.

9 Claims, No Drawings

COMPOSITIONS FOR CHEMICAL COPPER PLATING

This invention relates to compositions for chemical copper plating, and more particularly to chemical copper plating compositions containing a boron hydride compound as a reducing agent.

Compositions for chemical copper plating heretofore used comprise a water-soluble copper salt, reducing agent, and copper complexing agent and further contain, when desired, a buffer and stabilizer. Such compositions have the serious drawback that they are harmful to the human body due to the use of formaldehyde serving as the reducing agent and tend to dissipate during plating, deteriorating the environment. Moreover, the disproportionating reaction of formaldehyde inevitably causes the decomposition of the compositions, reducing the stability thereof.

In order to eliminate these drawbacks, chemical copper plating compositions have been developed which incorporate a boron hydride compound as a reducing agent. The compositions consist basically of a water-soluble copper salt, copper complexing agent and boron hydride compound. The use of boron hydride compound gives no harm to the human body and therefore causes no environmental pollution during plating due to it's poor varporization. However, the boron hydride compound has a high reducing ability and is very unstable in aqueous solutions, thus involving the drawback that it is readily decomposed with the copper complexing agent used conjointly therewith, giving off hydrogen which forms a copper precipitate. Accordingly, the compositions have very poor stability and are very disadvantageous for use in industrial operations. Furthermore, the compositions give platings which are not satisfactory in gloss.

An object of this invention is to provide compositions for chemical copper plating containing a boron hydride compound and having outstanding stability.

Another object of this invention is to provide compositions for chemical copper plating containing a boron hydride compound and capable of giving plated coatings having an excellent gloss.

These objects of this invention will become apparent from the following description.

This invention provides compositions for chemical copper plating containing a boron hydride compound serving as a reducing agent, a water-soluble copper compound and a copper complexing agent, the compositions being characterized in that the copper complexing agent is at least one of hydroxyalkyl-substituted ethylenediamines represented by the formula

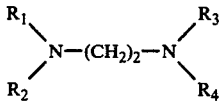

(I)

wherein $R_1$, $R_2$, $R_3$ and $R_4$ are the same or different and are each unsubstituted lower alkyl or hydroxyl- and/or carboxyl-substituted lower alkyl, and at least one of $R_1$, $R_2$, $R_3$ and $R_4$ is hydroxyl-substituted lower alkyl, and hydroxyalkyl-substituted diethylenetriamine represented by the formula

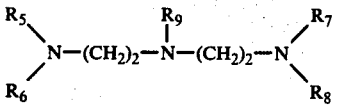

(II)

wherein $R_5$, $R_6$, $R_7$ and $R_8$ are the same or different and are each unsubstituted lower alkyl or hydroxyl- and/or carboxyl-substituted lower alkyl, $R_9$ is hydrogen or unsubstituted lower alkyl or hydroxyl- and/or carboxyl-substituted lower alkyl, and at least one of $R_5$, $R_6$, $R_7$, $R_8$ and $R_9$ is hydroxyl-substituted lower alkyl.

The hydroxyalkyl-substituted ethylenediamines useful as copper complexing agents in this invention are represented by the foregoing formula (I) wherein at least one of $R_1$, $R_2$, $R_3$ and $R_4$ must be hydroxyl-substituted lower alkyl. If the groups $R_1$, $R_2$, $R_3$ and $R_4$ are all lower alkyls having no hydroxyl substituent, the resulting composition tends to have reduced stability, whereas the stability increases with the increase in the number of the hydroxyl-substituted lower alkyl groups of the hydroxyalkyl-substituted ethylenediamine of the formula (I). Thus, it is preferable that the diamine have a greater number of hydroxyl-substituted lower alkyl groups. The hydroxyl-substituted lower alkyls are those having one hydroxyl substituent and may further include those having one hydroxyl substituent and one carboxyl substituent. Insofar as at least one of the groups $R_1$, $R_2$, $R_3$ and $R_4$ of the hydroxyalkyl-substituted ethylenediamine of the formula (I) useful in this invention is a hydroxyl-substituted lower alkyl, the other three groups may be unsubstituted lower alkyls or lower alkyls having one carboxyl substituent. Carboxyl-substituted lower alkyl groups result in slightly greater stability than unsubstituted lower alkyl groups. Alakli metal salts of those of hydroxyalkyl-substituted ethylenediamines (I) and hydroxyalkyl-substituted diethylenetriamines (II) having carboxyl group are also usable. Useful lower alkyls are those having 1 to 5, preferably 2 to 3, carbon atoms. Examples of useful hydroxyalkyl-substituted ethylenediamines are:

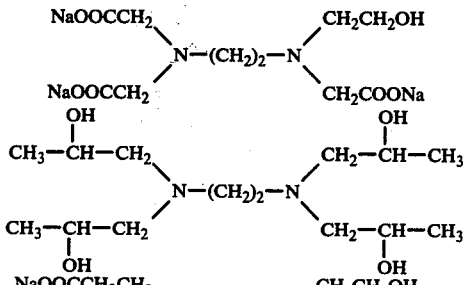

(1)

(2)

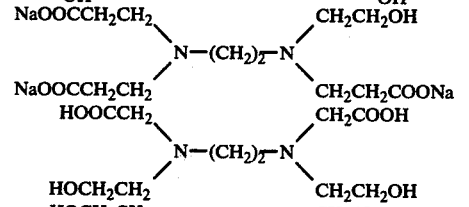

(3)

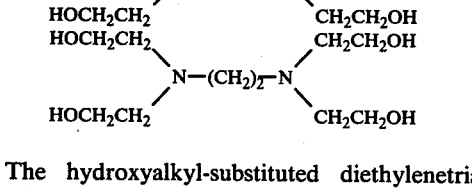

(4)

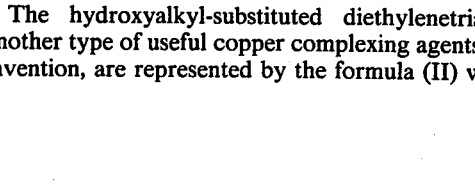

(5)

The hydroxyalkyl-substituted diethylenetriamines, another type of useful copper complexing agents in this invention, are represented by the formula (II) wherein at least one of $R_5$, $R_6$, $R_7$, $R_8$ and $R_9$ must be a hydroxyl-substituted lower alkyl group. If none of the groups $R_5$ to $R_9$ are hydroxyl-substituted lower alkyl, the result will be the same as is the case with the compounds of formula (I). Similarly, the composition will have increasing stability with the increase in the number of the hydroxyl-substituted lower alkyl groups. Accordingly, the greater the number of the hydroxyl-substituted lower alkyl groups, the better will be the result. The hydroxyl-substituted lower alkyl groups are those having one hydroxyl substituent and further contain those having one hydroxyl substituent and one carboxyl substituent. Insofar as at least one of the groups $R_5$ to $R_9$ of the hydroxyalkyl-substituted diethylenetriamine of the formula (II) useful in this invention is a hydroxyl-substituted lower alkyl, the other four groups may be unsubstituted lower alkyl groups or carboxyl-substituted lower alkyl groups. Carboxyl-substituted lower alkyl groups are preferable than the former, because the composition tends to have slightly increased stability. Examples of useful hydroxyalkyl-substituted diethylenetriamines are:

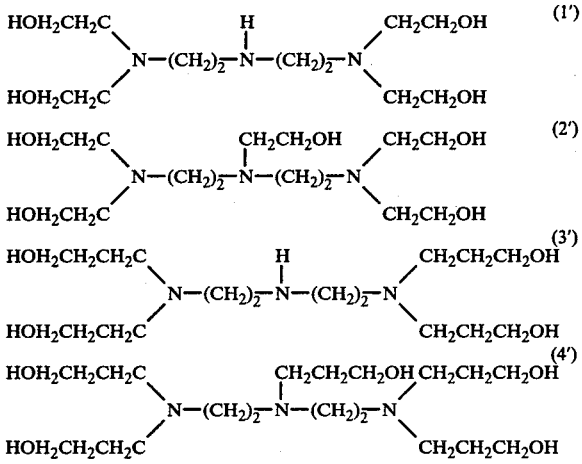

According to this invention, the hydroxyalkyl-substituted ethylenediamine of the formula (I) and hydroxy-alkyl-substituted diethylenetriamine (II) are used singly or conjointly. These compounds of the formula (I) and (II) are used in an amount of about 1 to about 10 times, preferably about 1.5 to about 3 times, the amount of the water-soluble copper compound in terms of mole. If the amount is less than the equimolar amount, copper hydroxide tends to separate out, whereas if it is more than 10 times the molar amount of the latter, the plating metal is difficult to deposit.

The water-soluble copper compounds useful in this invention include those heretofore used for conventional compositions for chemical copper plating containing a boron hydride compound as a reducing agent. Examples are copper sulfate, copper chloride, copper carbonate, copper pyrophosphate, copper fluoride, copper hydroxide, etc., among which copper sulfate, copper chloride and copper carbonate are preferable. These water-soluble copper compounds are used in an amount heretofore used of usually about 0.01 to about 0.2 mole, preferably about 0.03 to about 0.06 mole per liter of the composition.

Useful boron hydride compounds as the reducing agents in this invention are those heretofore used for chemical copper plating compositions containing a boron hydride compound, such as sodium borohydride, potassium borohydride, methoxy-substituted boron hydride, namely trimethoxy boron hydride, dimethylamineborane, isopropylamineborane and like amineboranes, among which preferable are $NaBH_4$, $KBH_4$, $H_3NBH_3$ and $(CH_3)_2HNBH_3$. The boron hydride compounds are used in an amount heretofore used of generally about 0.002 to about 0.04 mole, preferably about 0.009 to about 0.02 mole per liter of the composition.

As a rule, the chemical copper plating compositions of this invention comprise the specified copper complexing agent, water-soluble copper compound and boron hydride compound and must have a pH of 12 to 14. If the pH is less than 12, the boron hydride compound is prone to hydrolysis, with the resulting disadvantage that the hydrogen produced by the hydrolysis causes the precipitation of copper. If the pH is more than 14, a plating ability tends to lower. The pH is adjusted usually with the use of an alkali hydroxide such as sodium hydroxide or potassium hydroxide. The preferred pH is 12.5 to 13.5.

When compounds having a carboxyl-substituted lower alkyl are used as the copper complexing agents of the formulae (I) and (II), the compounds will be converted to alkali metal salts on reaction with the alkali hydroxide. The effects contemplated by this invention are similarly attainable in this case.

The chemical copper plating compositions of this invention can further contain a stabilizer such as sodium cyanide, potassium ferrocyanide or like water-soluble cyano compound, 2-mercaptabenzothiazole, 2-mercaptobenzoimidazole or like heterocyclic sulfur compound, succinonitrile, lactonitrile or like nitrile compound, diethylthiourea, phenylthiourea or like N-derivative of thiourea. Such stabilizer is used in an amount of about 5 to about 500 mg, preferably about 10 to about 250 mg. per liter of the composition.

Chemical copper plating is carried out exactly in the usual manner with use of the compositions of this invention. More specifically, the article to be plated is pretreated in the usual manner first by etching, then by sensitization and thereafter by activation. The article is then subjected to chemical plating in the usual manner. When desired, the surface of the article may be subjected, prior to etching, to roughening treatment by mechanical means, for example, by liquid honing or barrel tumbling or the like. The etching is a chemical surface roughening process for ensuring improved adhesion between the article and the plated coating with use of an aqueous solution of a mixture of chromic acid and sulfuric acid in proportions which are determined suitably depending on the kind of the material of the article to be plated. For ABS resin, for example, the aqueous solution consists of 400 to 420 g of chromic acid and 380 to 400 g of sulfuric acid per liter of the solution. The article to be plated is immersed in the aqueous solution of the acid mixture at 60° to 70° C. for 5 to 10 minutes. Prior to sensitization, the article may preferably be washed with an aqueous solution of hydrochloric acid to remove the chromium component of the etching solution remaining thereon. The article is sensitized by being immersed in an aqueous hydrochloric acid solution of stannous chloride at 15° to 35° C. for about 2 to 10 minutes. Typically, the sensitizing solution comprises 10 to 20 g of stannous chloride, 15 to 20 cc of hydrochloric acid (36%) and 5 g of hydroquinone per liter of the solution. The activation which is conducted to form a catalyst layer for the deposition of copper is carried out with use of an aqueous solution containing about 0.3 to about 0.5 g of palladium chloride or gold chloride and about 3 to 10 cc of hydrochloric acid (36%) per liter of the solution. The article is immersed in the solution at room temperature to about 40° C. for about 30 seconds to about 5 minutes.

The article thus pretreated is then immersed in the composition of this invention for chemical plating. The chemical plating operation is conducted under the conditions of 15° to 40° C. for 5 to 20 minutes.

As compared with conventional chemical copper plating compositions containing a boron hydride compound as a reducing agent, the chemical copper plating compositions of this invention have higher stability and give coatings having an outstanding gloss which is more excellent than the gloss of the coatings formed from conventional chemical copper plating compositions of the copper-formaldehyde type. Furthermore, the present compositions are free of pollution problems since they contain no formaldehyde.

This invention will be described below in greater detail with reference to examples.

EXAMPLES 1 to 5

The compounds listed in Table 1 below are used in the specified amounts to prepare chemical copper plating compositions of this invention.

Table 1

| Ex. No. | Component | Amount (g/l) | pH |
|---|---|---|---|
| 1 | Copper sulfate | 8 | 12.8 |
| | Compound (1) | 15 | |
| | Sodium hydroxide | 8 | |
| | Sodium boron hydride | 0.2 | |
| | Potassium ferrocyanide | 0.05 | |
| 2 | Copper sulfate | 8 | 12.8 |
| | Compound (3') | 20 | |
| | Sodium hydroxide | 8 | |
| | Sodium boron hydride | 0.2 | |
| | Potassium nickel cyanide | 0.01 | |
| | 2-Mercaptobenzothiazole | 0.001 | |
| 3 | Copper sulfate | 10 | 12.8 |
| | Compound (1) | 10 | |
| | Compound (3') | 10 | |
| | Sodium hydroxide | 10 | |
| | Sodium boron hydride | 0.5 | |
| | Sodium cyanide | 0.05 | |
| | Diethylthiourea | 0.01 | |
| 4 | Copper sulfate | 8 | 12.8 |
| | Compound (2) | 15 | |
| | Sodium hydroxide | 8 | |
| | Sodium boron hydrode | 0.2 | |
| | Sodium cyanide | 0.05 | |
| 5 | Copper sulfate | 8 | 12.8 |
| | Compound (3') | 15 | |
| | Sodium hydroxide | 8 | |
| | Sodium boron hydride | 0.2 | |
| | Sodium cyanide | 0.05 | |

The compounds (1),(2) and (3') are the same as described in pages 5 to 6 and 7.

The compositions of this invention prepared in Examples 1 to 5 are tested for various properties. The results are given in Table 2. The properties listed are determined by the following methods.

Stability of the Composition

A number of test pieces (ABS resin, surface area: 100 $cm^2$) to be plated are prepared by the pretreatment described below. The test piece is immersed in one liter of the composition at 30° C. for 10 minutes. This procedure is repeated for a certain number of test pieces until the composition undergoes self-decomposition. The sum of plated areas of the resulting test pieces is measured. The pretreatment is conducted in the following manner. The test piece is immersed in a degreasing solution ("Ace-Cleaner", trade mark, product of OKUNO Chemical Industry Co., Ltd.) at 50° to 65° C. for 6 minutes, then rinsed and thereafter etched by being immersed in an aqueous solution containing 400 g of chromic acid and 200 ml of sulfuric acid per liter of the solution at 60° to 65° C. for 7 minutes. Subsequently, the test piece is rinsed with water, immersed in a 5% aqueous solution of hydrochloric acid for 2 minutes to remove the remaining chromium component and then sensitized by being immersed in an aqueous solution containing 15 g of stannous chloride per liter of the solution for 4 minutes. The test piece is thereafter rinsed with water and activated by being immersed in an aqueous solution of palladium chloride (0.2 g/l) for 2 minutes. The test piece is finally rinsed with water.

Effective Period of the Composition

Test pieces (ABS resin, surface area: 50 $cm^2$) are plated one after another by being immersed in one liter of the composition at 30° C. for 10 minutes in the same manner as in the stability test. While replenishing the components of the composition, the plating procedure is repeated insofar as plating can be conducted with the composition. The sum of the times required for plating is measured.

Glass and Color

The test piece is plated at 30° C. for 10 minutes and then checked with the unaided eye for the gloss and color of the resulting coating surface.

Deposition Rate

The test piece is plated at 30° C. for 10 minutes, and the thickness of the plated coating is measured. The thickness of the coating per hour of plating time is calculated to determine a deposition rate ($\mu$/hr.).

For comparison, Table 2 below shows the properties of the compositions of Comparison Examples 1 to 4 determined in the same manner as above.

COMPARISON EXAMPLES 1 to 3

Compositions are prepared in the same manner as in Example 4 except that the 15 g of compound (2) is replaced by 20 g of Rochelle salt (Comparison Example 1), by 15 g of sodium nitrotriacetate (Comparison Example 2), and by 15 g of sodium ethylene-diaminetetraacetate (Comparison Example 3).

COMPARISON EXAMPLE 4

A composition is prepared in the same manner as in Example 4 except that 15 g of compound (2) is replaced by 20 g of Rochelle salt and that 0.2 g of sodium borohydride is replaced by 20 g of p-formaldehyde.

Table 2

| | Stability ($cm^2$) | Effective period(hr) | Colour | Gloss | Deposition rate($\mu$/hr.) |
|---|---|---|---|---|---|
| Ex. 1 | 12000 | 40 | Brown | Glossy | 1.5 |
| Ex. 2 | 16000 | 50 | Pinkish brown | Glossy | 1.5 |
| Ex. 3 | 16000 | 60 | Pinkish brown | Glossy | 1.5 |
| Ex. 4 | 15000 | 50 | Pinkish brown | Glossy | 1.5 |
| Ex. 5 | 15000 | 50 | Pinkish brown | Glossy | 1.5 |

Table 2-continued

| | Stability ($cm^2$) | Effective period(hr) | Colour | Gloss | Deposition rate($\mu$/hr.) |
|---|---|---|---|---|---|
| Comp. Ex. 1 | 1000 | <1 | Dark brown | None | <1.0 |
| Ex. 2 | 2000 | <2 | Dark brown | None | <1.0 |
| Ex. 3 | 2000 | <2 | Dark brown | None | <1.0 |
| Ex. 4 | 10000 | 30 | Pinkish brown | Glossy | 2 |

What we claim is:

1. A composition for chemical copper plating which consists essentially of 1. a water-soluble copper compound in an amount of about 0.01 to about 0.2 mole per liter of the composition,
2. a boron hydride compound selected from the group consisting of sodium borohydride and potassium borohydride in an amount of about 0.002 to about 0.04 mole per liter of the composition,
3. a copper complexing agent selected from the group consisting of at least one of hydroxyalkyl-substituted ethylenediamines represented by the formula

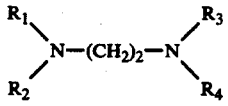

(I)

wherein $R_1$, $R_2$, $R_3$ and $R_4$ are the same or different hydroxyl-substituted lower alkyl, and hydroxyalkyl-substituted diethylenetriamines represented by the formula

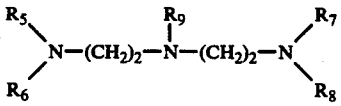

(II)

wherein $R_5$, $R_6$, $R_7$ and $R_8$ are the same or different hydroxyl-substituted lower alkyl and $R_9$ is hydrogen or hydroxyl-substituted lower alkyl in an amount of about 1 to 10 times the amount of the water-soluble copper compound in terms of mole, and optionally 4. at least one of stabilizers selected from the group consisting of sodium cyanide, potassium ferrocyanide, 2-mercaptobenzothiazole, 2-mercaptobenzoimidazole, diethylthiourea and phenylthiourea in an amount of about 5 to about 500 mg. per liter of the composition, said composition having pH of 12 to 14.

2. A composition as defined in claim 1 wherein the hydroxy-alkyl-substituted ethylenediamine represented by the formula (I) is tetra-hydroxyalkylethylenediamine.

3. A composition as defined in claim 1 wherein $R_5$ to $R_9$ are each hydroxyl-substituted lower alkyl.

4. A composition as defined in claim 1 which contains at least one of hydroxyalkyl-substituted ethylenediamines represented by the formula (I) and hydroxyalkyl-substituted diethylenetriamines represented by the formula (II) in an amount of about 1 to about 3 times the amount of the water-soluble compound in terms of mole.

5. A composition as defined in claim 1 wherein the hydroxyalkyl-substituted ethylenediamines represented by the formula (I) are at least one compound selected from the group consisting of:

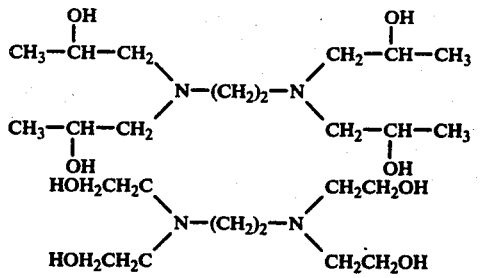

6. A composition as defined in claim 1 wherein the hydroxyalkyl-substituted diethylenetriamines represented by the formula (II) are at least one compound selected from the group consisting of:

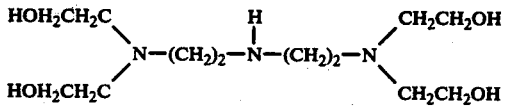

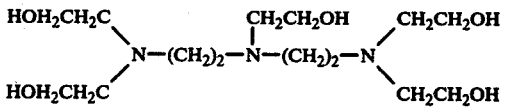

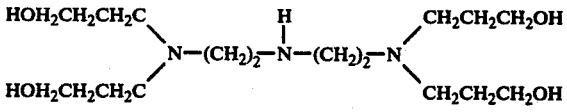

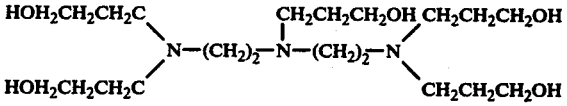

7. A composition as defined in claim 1 which contains the boron hydride compound in an amount of about 0.009 to about 0.02 mole per liter of the composition.

8. A composition as defined in claim 1 which contains about 10 to about 250 mg of the stabilizer per liter of the composition.

9. A composition as defined in claim 1 which has a pH of 12.5 to 13.5.

* * * * *